United States Patent [19]

Zaboronok et al.

[11] 4,130,416

[45] Dec. 19, 1978

[54] METHOD OF PREPARING A FURNACE CHARGE WHEN SMELTING REFRACTORY METALS AND ALLOYS

[76] Inventors: Georgy F. Zaboronok, pereulok Obukha, 4, kv. 56; Vladimir E. Efimov, Leninsky prospekt, 37, kv. 268, both of Moscow; Alexandr T. Kozlov, ulitsa Elektrifikatsii, 24a, kv. 130, Lubertsy, Moskovskoi oblasti, all of U.S.S.R.

[21] Appl. No.: 736,269

[22] Filed: Oct. 27, 1976

Related U.S. Application Data

[63] Continuation of Ser. No. 352,632, Apr. 19, 1973, abandoned.

[51] Int. Cl.[2] ..... C22B 4/00

[52] U.S. Cl. ..... 75/10 R; 75/65 EB

[58] Field of Search ..... 75/10 R, 65 EB

[56] References Cited

U.S. PATENT DOCUMENTS

| | | | |
|---|---|---|---|
| 2,813,921 | 11/1957 | Vordahl | 75/10 R |
| 3,183,077 | 5/1965 | Kraus | 75/49 |
| 3,467,167 | 9/1969 | Mahin | 75/49 |

*Primary Examiner*—P. D. Rosenberg

[57] ABSTRACT

Method of preparing a furnace charge for smelting refractory hard metals and alloys wherein, pressed-out and uncaked briquettes are fed to the furnace on trays made of a metal readily evaporating at the high alloy melting point. This permits to simplify the technology of preparing charge pieces, improve the quality of the alloys smelted, increase the yield of quality metal and reduce costs.

5 Claims, 1 Drawing Figure

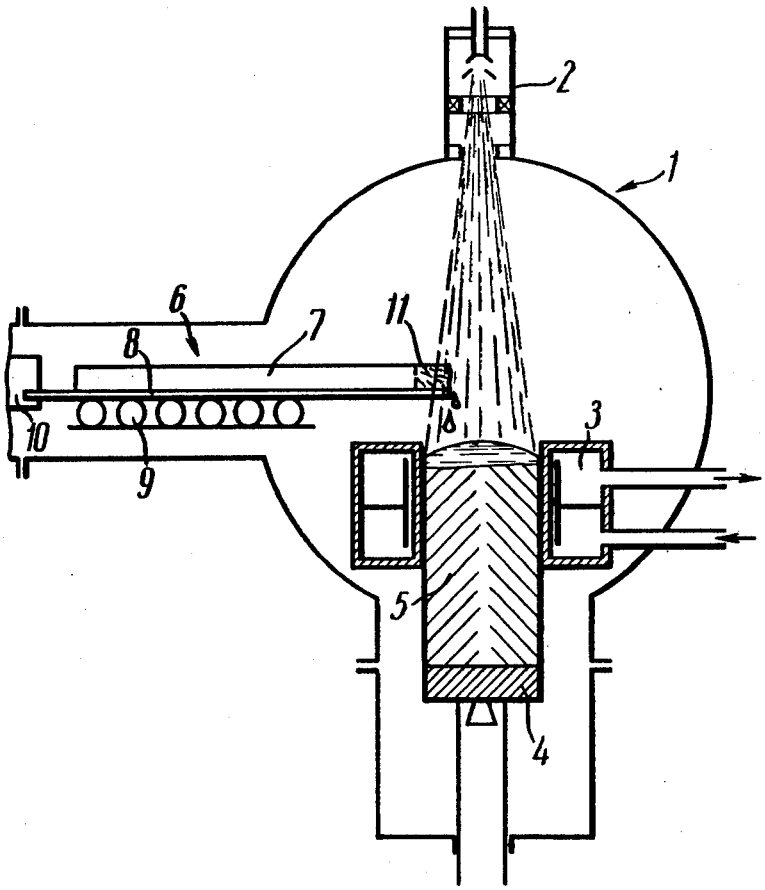
2
1
6
7
11
8
10
9
3
5
4

METHOD OF PREPARING A FURNACE CHARGE WHEN SMELTING REFRACTORY METALS AND ALLOYS

This is a continuation, of application Ser. No. 352,632, filed Apr. 19, 1973, now abandoned.

The present invention relates to methods of smelting ingots from refractory metals and alloys on their base and more particularly to a method of preparing charge pieces for the above purpose.

This invention can be utilized for smelting ingots from refractory metals and their alloys in electron-beam furnaces.

Known in the art is a method of preparing a furnace charge, which consists in mixing the charge components in order to obtain a uniform mixture, its subsequent pressing-out into briquettes, caking and feeding to a furnace for drop smelting therein.

In smelting refractory melals and alloys on their base in vacuum electron-beam or plasma furnaces, the mechanical properties of obtained metals largely depend on their chemical homogen/ity determined, in its turn, substantially by the uniformity of a charge being utilized. Consequently, the smelting of refractory metals and their alloys with the use of expendable electrodes' requires the provision of charge pieces in which all the alloy components are uniformly scattered throughout the charge volume or are present, in a preset proportion, in any successively melted volume of said charge piece, which is adequate to not more than two thirds of the volume of the liquid bath of a metal.

All the alloy components are present in the charge essentially as powders. Besides, when necessary, some deoxidizing elements are added to the charge mixture, e.g., Ti or Zr.

After having been mixed for a prolonged period of time (some 18 hours), the charge is pressed out into briquettes. Normally, for increasing the pressing ability of the charge, some softeners can be introduced into the powders mixture during the mixing, e.g., paraffin dissolved in gasoline, in terms of 3 to 5 grams per kilogram of the mixture. The pressing-out of briquettes is done in steel press-moulds by hydraulic presses, after which said briquettes are subjected to caking. The more alloyed is the melt, the more complicated and difficult are the operations of mixing and caking.

Cases are not rare in practice when the quality of briquettes, specifically their shape after caking, fails to meet the required demands. For higher strength, the pressed-out briquettes are caked in vacuum. Thus, when smelting out a molybdenum-based alloy, the charge briquettes are caked in a vacuum of $10^{-3} + 10^{-4}$ mm of mercury column, according to the following schedule: at t = 800° C. for one hour and at t = 1200° C. for three more hours. Thereafter comes one more caking operation, the so-called fusion, carried out according to the following schedule: at t = 1600° C. for 30 min, at t = 1700° C. for 30 min and at t = 1950° C. for 25 min.

The briquettes thus produced have a density equal to 90–95% of the theoretical one. The caking, however, brings about the chemical heterogeneity of the charge, because the ends of said briquettes are held in clamps that serve as current leads and cannot be caked all through due to the cooling action of said clamps. Therefore, the carbon content at the ends and in the middle of the briquette length is, correspondingly, 0.005 + 0.015% and 0.05%, the oxygen content being 0.02% and 0.035%.

In general, it is preferable, in the course of the briquette caking and fusion to ensure a contact between $O_2$ and C to make the reaction continue up to smelting. This is achieved by a prolonged mixing of the charge components until the microuniformity of its composition is secured.

Further, from the caked briquettes they weld runners each 1 to 2 meters in length, from which expendable electrodes or charge pieces are collected to be then smelted in a furnace of some type. In the course of runners welding, the briquette ends that were not caked all through must be cut off. This is one of the disadvantages of the known method of charge mixing, which results in a reduced yield of quality metal. Furthermore, the end of a charge piece also becomes discarded after smelting.

Another disadvantage of the known method is the complexity of the process, specifically, the prolonged mixing of the charge components, the necessity of the fraction scattering of the powders and of such operations as caking and fusion.

It is an object of the present invention to eliminate the abovementioned disadvantages and provide a method of preparing a furnace charge, that simplifies the technological process of its preparation and helps increase the yield of quality metal.

This object is accomplished by providing a method of preparing a furnace charge for further smelting of refractory hard metals and alloys, which consists in mixing the charge components in order to obtain a uniform mixture, its subsequent pressing-out into briquettes and their feeding to a furnace for drop smelting.

According to the invention, the charge contains low-melting metal deoxidants easily evaporating at an alloy melting point, in quantities exceeding the quantity of deoxidant as is required, under given actual smelting conditions, to remove or reduce the oxygen to a preset residual level, while the pressed-out briquettes are fed to the furnace on trays made of a metal readily evaporating at the alloy melting point. As tray material, use can be made of foil (strip) wastes of the metal used as the alloy base, such wastes being often available at hand, and their use being economically justified in the present case.

Since said briquettes are fed on the trays, they may have a much lower density and strength. Besides, metal deoxidants improve the pressing ability of the charge, thus making unnecessary the introduction of carbon-containing softeners into its composition.

It is practical that the metal deoxidants be taken from the group containing Al, Ti, and Zr.

The above metals can serve as alloy additives at the same time and also step up the elimination of admixtures from the alloys.

Following hereinbelow is a detailed description of the invention with references to the sole FIGURE of the appended drawing which shows schematically a furnace for producing refractory metals and alloys from a prepared charge piece to be smelted.

Used as original powders during the charge preparation are powders of various fractional composition, which permits to avoid the operation of powders scattering normally required for the elimination of a fraction with a higher content of admixtures, e.g., oxygen, or for the production of caked briquettes of a required density.

In the proposed method, the mixing of the charge components results in the preparation of mixtures that correspond to a prescribed composition not in a microvolume but in a volume corresponding to the weight of a melt drop when melting a charge piece. This permits to appreciably cut the time of the components mixing. During the mixing, metal deoxidants are added to the powders mixture, said deoxidants readily evaporating at the alloy melting point. The deoxidants improve the pressing ability of the mixture and contribute to a lower density of the briquettes. This makes unnecessary the introduction of carbon-containing softeners.

The pressing-out of briquettes from the prepared mixture is analogous to the operation under the known method. At the same time, the strength of said briquettes may be only sufficient to permit their conveyance and tray-laying. This helps avoid the operation of briquette caking. Trays are made of a metal readily evaporating at the alloy melting point.

In case the strength of the pressed-out briquettes is not sufficient and results in their subsequent destruction during conveyance or tray-laying, as is the case, for instance, with an elevated carbon content, some metal deoxidants such as aluminum or titanium should be added to the powders mixture.

When laid on trays, the pressed-out briquettes serve as charge pieces, i.e. expendable electrodes.

A tray is made on a bending machine from a sheet whose thickness ensures a strength sufficient to hold briquettes.

The melting of a charge piece is done in a melting furnace 1 (FIG. 1) equipped with an electron gun 2. Said furnace 1 accomodates a crystallizer 3 with a bottom 4 for forming an ingot 5. Thereafter the inside of the furnace 1 is made air-tight and evacuated. A charge piece 6 consisting of briquettes 7 and a tray 8 is placed on a roller conveyor 9. An end of the tray 8, free from the briquettes 7, is secured to a pusher 10 of a charge feeding mechanism (not shown).

Once a required degree of evacuation is achieved in the furnace 1, an electron beam of the gun 2 comes to heat the end of the charge piece 6 and the bottom 4. During the heating of said charge piece 6 in a hot zone 11, gases present in the charge are forced out of the latter. After the degassing of the end of the charge piece 6, the charge feeding mechanism is actuated. The end of the charge piece is melted and the metal flows off in drops into the crystallizer 3 onto the bottom 4 which sinks as the amount of the metal thereon is increasing. In the lower portion of the liquid bath the metal gets crystallized into the ingot 5.

The briquettes being all melted out, the end alone of the tray 8 survives, as it is clamped in the charge feeding mechanism. The evacuation of the ingot 5 from the furnace 1 is carried out after its cooling and the depressurization of said furnace 1.

Since the briquette density is rather low, the porosity and the gas permeability of the briquettes 7 are adequately high, and this permits to eliminate a great amount of gas admixtures already on the charge piece 6 as it approaches the melting zone. Moreover, there emerges a possibility of smelting quality ingots even from a charge with a higher content of such admixtures as oxygen, for instance, as compared with a charge prepared by the known method.

The readily evaporating metal deoxidants contribute to stepping up the metal purification of the melted charge piece for one more reason, specifically, because the zone 11 of the charge 6 heating and degassing expands thanks to the softening and melting of low-melting additives such as aluminum that improve the contact between the particles of the charge piece and increase its heat conductivity. Owing to the high gas permeability of the briquettes 7, the decarbonizing reaction may nearly all take place prior to the melting of the charge piece 6. Extra oxygen present in said charge piece 6, which is particularly important for alloys having a low carbon content, is eliminated from the metal as a result of the reaction with the metal deoxidants, the formation of their oxides and subsequent evaporation of the latter that are condensed on the walls of the furnace 1 and do not affect the vacuum.

In general, the amount of deoxidants in the mixture depends on the oxygen concentration in the charge and is limited by the possibility of a spontaneous metallothermal reduction of a powders mixture as well as by the splashing of the metal from the melted end of the charge piece 6, which is caused by intensive evaporation of the deoxidant if introduced in a large quantity. Normally, the amount of metal deoxidants is 0.1–5% in mass.

For alloys characterized by their low ability of pressing powder mixtures, the amount of deoxidants that also work as peculiar softeners in pressing can be increased. Excessive deoxidants evaporate during the melting almost completely thanks to their gas absorptive power, which is conducive to a deeper vacuum in the melting zone and an increase in the yield of an expensive quality metal as the alloy base; this is owing to a reduced evaporation of said metal in the form of oxides, because when combined with a deoxidant, oxygen escapes from the alloy. When the oxygen content in the original powders is low and the pressing ability of the charge is satisfactory, metal deoxidants may not be added.

Furthermore, the yield of quality metal, especially in case of alloys with a high carbon content, characterized by an intensive gas separation during the melting, can be raised by limiting the metal splashing when melting a charge piece. This is achieved by increasing considerably its porosity and gas permeability right ahead of the zone of liquid metal formation, which prevents intensive gas separation and metal splashing within the melting zone.

To comply with a preset mass flow rate during the melting, it is practical to provide a charge piece 6 of a larger section and smaller length so as to ensure a lower linear speed of its feed to the melting zone. In that case, a large mass of the charge piece 6 can be heated to elevated temperatures and the time period of the intensive purification of the alloy from detrimental admixtures is extended.

The proposed method permits to bring a greater amount of readily evaporating low-melting metals into the composition of charge pieces 6, as the operation of caking at which a briquette partial melting could occur is no more present. Now it becomes possible to smelt alloys based on refractory metals such as tungsten, for instance, that feature rather a high content of readily evaporating alloy elements, as the melting of the piece 6 prepared from the charge mixed well enough occurs at a temperature slightly higher than that of the alloy melting.

For a better understanding of the following examples it should be understood that the hard metals which are processed by drop smelting in accordance with the invention have relatively high melting temperatures, for example 2625° C. for molybdenum and 3415° C. for tungsten. In contradistinction, the deoxidants proposed by the invention, preferably is an amount of up to 5% of the charge weight, have substantially lower melting points, such as, for example, about 600° C. for aluminum, 1672° C. for titanium and 1855° C. for zirconium. This allows to bring about a substantially complete evaporation of the deoxidants at the high melting point of the smelted hard metal and alloys, the deoxidants thus acquiring getter properties in their gaseous state.

Following hereinbelow are examples of obtaining alloys from charge pieces prepared by the proposed method.

EXAMPLE 1

Smelting BM-I alloy

Alloy composition: No — base, C — up to 0.01%, Ti — up to 0.4% and Zr — 0.08- 0.25%.

From the powders of Mo as well as Ti, Zr, and Al there was prepared 20 kg of a mixture containing 0.15% Zr, 0.5% Ti and 0.3% Al in a drum mixer 300 mm in diameter and 300 mm in length. It will be noted that the percentage of the deoxidants zirconium and titanium amounts to 0.65%.

After having being mixed up for one hour, the mixture became practically uniform, which was proved by a chemical analysis of some 10 kg of samples taken selectively from different places of the drum. Portions of 2.4 kg each were pressed by a mechanical hydraulic press in steel-made horizontal press-moulds into briquettes 40 mm in diameter and 250 mm in length. Moulding force — 300 T. Specific moulding pressure — 3 t/cm$^2$. Density of briquettes — 70% of the theoretical one. Besides, they checked hydrostatic pressing-out of briquettes 40 mm in diameter and 850 in length at a pressure of 2000 atm (specific moulding pressure — 2.0 t/cm$^2$). The density of briquettes in that case was 50% of the theoretical one. Briquettes were laid on in one or three rows close to each other channel-type trays made of a titanum band measuring 100 × 0.5 × 1850 mm. The holder of the feeding mechanism was secured to the free end of the tray some 100 mm in length. The smelting of an ingot 100 mm in diameter was carried out by a 90 kVt electron beam in a vacuum of $10^{-3}$–$10^{-4}$ mm of mercury column at a rate of 6 mm/min by ingot height inside the GDR-made EMO-200 furnace. Evaporation loss amounted to 5%, 1.5% Ti including. However, this smelting mode characterizes but the efficiency of remelting the above charge pieces, as the smelting of alloy ingots takes place normally at a lower rate typical of the smelting of ingots from charge pieces prepared by the known method, too.

EXAMPLE 2

Smelting BB-2 alloy

Alloy composition: W — base, Nb — 0.03–0.05%; C — 0.04–0.1%.

From the powders of W, Nb, C, and Ti there were weighed portions of 20 kg tungsten, 40 g niobium, 40 g carbon, and 100 g titanum. The powders are charged into a drum mixer and mixed for one hour. The prepared mixture is used to fill tubes made of HO-68-I rubber, 50 mm in inner diameter and 850 mm in length. The tube ends are blocked hermetically and the moulding takes place in a hydrostatic press at 2.5 thous atm.

From a titanum BT-1 and band 70 mm wide, 1800 mm long and 0.5 mm thick a channel-type 40 mm wide tray with 15 mm shelves is made on a bending machine.

The pressed-out briquettes are laid on the above tray and the latter is then positioned on a roller conveyor of the charge feeding mechanism. All the subsequent operations are similar to those typical of the smelting of tungsten ingots from charge pieces prepared by the known method. A slight difference is that the period of heating the end of a charge piece prior to metal melting is extended by 20 min.

Conditions for smelting an ingot 85 mm in diameter are as follows:

Beam current — 7.1–7.5 a
Start voltage — 26 kV
Vacuum — $5.10^{-4}$–$10^{-4}$ mm of mercury column
Ingot smelting rate 1.5 mm/min or 10 kg/h

EXAMPLE 3

Smelting BM-3-II alloy

Alloy composition: Mo — base; C — 0.15–0.25%; Zr — 0.45 – 0.65%; Ti — 0.1–0.4%; Nb — 1.0 – 1.8%. Used as original materials were the powders of Mo, Zr, Ti, Nb and C in the form of lamp black, that were weighed in the following portions: 21.5 kg Mo; 0.75% or 165 g Zr; 0.35% or 77 g C.; 0.5% or 110 g Ti; and 1.30% or 300 g Nb. The amount of the added deoxidants titanium and zirconium makes up 1.25%.

These powders were charged into a 300 mm drum and mixed for 3 hours, the drum r.p.m. being 50.

The mixed powders were weighed in portions of 2400 g each. Each portion was charged into a press-mould and pressed out into 43 mm, 250 mm long briquettes at a pressure of 3 t/cm$^2$. Moulding is also possible in rubber jackets by a method of hydrostatic pressing at 2500 atm.

The pressed-out briquettes were laid on trays made on a bending machine from a titanum band 0.5 mm thick and 100 mm wide. The tray is channel-shaped. Briquettes were laid so as to provide two briquettes at a time in a cross section, the successive briquettes fitting the preceding ones.

Such a charge piece was loaded into a GDR-made EMO-200 electric furnace.

The preparation of the furnace for melting does not differ at all from the preparation of the furnace for smelting refractory ingots from other types of charge pieces.

Smelting conditions:

Electron beam current — 4 a
Start voltage — 27 kV
Remaining pressure — $1.5.10^{-4}$–$2.10^{-3}$ mm of mercury column
Crystallizer diameter — 100 mm
Ingot smelting rate — 2.5 mm/min The chemical analysis of an obtained ingot showed the following alloy composition:

0.21% C.; 0.6% Zr; 0.1%; Ti; 1.1% Nb; and the rest to Mo.

EXAMPLE 4

Smelting tungsten-based alloy

Alloy composition: W — base; Mo — 2.5 – 3.5%; Re — 0.1–0.3%.

Used as original materials were the powders of W, Mo, Ti and Re, which were weighed in the following portions: W — 18 kg; Mo — 9.05% or 1.8 kg; Ti — 0.951% or 90 g; and Re — 0.1% or 20 g. The amount of the deoxidant titanium used in this example constitutes the percentage of 0.951%.

The powders were charged into a 300 mm drum for mixing therein for 3 hours at 50 r.p.m.

The mixed powders were weighed into portions of 4.5 kg each. Each portion was loaded into a press-mould for pressing out into briquettes 43 mm in diameter and 250 mm in length at a pressure of 3 t/cm$^2$.

The prepared briquettes were laid on a channel-shaped tray measuring 15 × 40 × 15. The tray was made from a 0.5 mm thick titanium band. It is 40 mm wide and its shelves are 15 mm high. Briquettes were laid so that there should be one briquette in the section at a time.

Such a charge piece was loaded into the EMO 200 electron-beam furnace.

Smelting conditions were as follows:

Electron beam current — 6.3–6.6 a
Start voltage — 23 kV
Remaining gas pressure in the furnace — $2.10^{-4}$–$4.10^{-4}$ mm of mercury column
Crystallizer diameter — 70 mm
Ingot smelting rate — 450 g/min or 6 mm/min The chemical analysis of the obtained ingot showed the following alloy composition: Mo — 2.5%; Re — 0.1%; Ti — 0.008%; C — 0.005%, and W — the rest.

An indirect criterium for evaluating the quality of obtained metals and alloys is to be their mechanical properties, the more so as they are crucial in determining the sphere of alloys application. At present the utilization of the proposed method of preparing a charge for the electron-beam smelting of tungsten permitted to degrade the temperature of its cold brittleness in a recrystallized state to 300°–350° C. compared with 550°–600° C. for the metal during the vacuum arc remelting.

What we claim is:

1. A method of preparing a furnace charge for drop smelting refractory metals and alloys having a melting point of at least 1900° C. in electron-beam and plasma-arc furnaces with an approximately horizontal feed of a charge therein, comprising the steps of: introducing deoxidant metals into a powdery charge, the metals having a melting point lower than that of the charge and a vapor pressure at least 100 times higher than that of a base metal in the charge at its melting point to permit evaporation in solid state before a fusing zone at a level substantially different from the content in the initial charge and being selected from the group of metals consisting of aluminum, titanium, zirconium and their combinations, in an amount of up to 5 weight percent by mass of the charge; mixing the charge components until a uniform mass is obtained; pressing the mass of said charge into porous briquettes having a density of 50% to 70% of the theoretical and a strength sufficient for being transported on trays; and disposing the briquettes on the trays, made of metal, being readily evaporable at the alloy melting point for making the charge to be fed into the furnace for subsequent drop melting, and substantially completely evaporating deoxidant metals.

2. The method as defined in claim 1, for smelting a BM-I alloy, having a composition: Mo — base; C — up to 0.01%; Ti — up to 0.4%; and Zr — 0.08–0.25%, wherein the charge components are made up of 20 kg of a mixture containing 0.5% Ti and 0.15% Zr, including 0.3% Al.

3. The method as defined in claim 1, for smelting a BB-2 alloy, having a composition: W — base; C — 0.04–0.1%; and Nb — 0.03–0.05%, wherein the charge components are made up of a mixture containing 20 kg tungsten, 40 grams C and 40 grams Nb, including 100 grams Ti.

4. The method as defined in claim 1, for smelting a BM-3-II alloy, having a composition, Mo — base; C — 0.15–0.25%; Ti — 0.1–0.4%; Zr — 0.45–0.65%; and Nb — 1.0–1.8%, wherein the charge components are made up of a mixture containing 21.5 kg of Mo, 0.35% or 77 grams C, 0.5% or 110 grams Ti, 0.75% or 165 grams Zr and 1.30% or 300 grams Nb.

5. The method as defined in claim 1, for smelting a tungsten-based alloy, having a composition: W — base; Mo — 2.5 - 3.5%; and Re — 0.1–0.3%, wherein the charge components are made up of a mixture containing 18 kg of W, 9.05% or 1.8 kg, Mo, and 0.1% or 20 grams Re, including 0.951% or 90 grams Ti.

* * * * *